United States Patent [19]

Savin et al.

[11] 4,060,127

[45] Nov. 29, 1977

[54] SHELL-AND-TUBE HEAT EXCHANGER

[76] Inventors: Nikolai Ivanovich Savin, ulitsa Zvezdinka 3, kv. 71; Tamara Alexandrovna Ternikova, prospekt Kirova, 2, kv. 63; Vladimir Jurievich Filippov, ulitsa Piskunova, 32, kv. 14; Vladimir Ivanovich Shiryaev, ulitsa Strazh Revoljutsii, 22, kv. 19, all of Gorky, U.S.S.R.

[21] Appl. No.: 568,184

[22] Filed: Apr. 15, 1975

[51] Int. Cl.[2] ..... F28F 9/02

[52] U.S. Cl. ..... 165/145; 165/158

[58] Field of Search ..... 165/145, 158, 159, 144; 122/32, 34

[56] References Cited

U.S. PATENT DOCUMENTS

| | | | |
|---|---|---|---|
| 2,907,644 | 10/1959 | Cunningham et al. | 165/1945 X |
| 2,961,221 | 11/1960 | Friese et al. | 122/510 |
| 3,205,939 | 9/1965 | Huet | 165/144 |

FOREIGN PATENT DOCUMENTS

| | | | |
|---|---|---|---|
| 274,139 | 6/1970 | U.S.S.R. | 165/158 |

*Primary Examiner*—Carroll B. Dority, Jr.
*Assistant Examiner*—Theophil W. Streule, Jr.
*Attorney, Agent, or Firm*—Holman & Stern

[57] ABSTRACT

A shell-and-tube heat exchanger comprises a shell which houses a tubular core, with an array of heat transfer tubes uniformly spaced between the shell walls and the core, said heat transfer tubes being secured in an inclined upper tube plate and an inclined lower tube plate. The shell-and-tube heat exchanger of the present invention is characterized by that each tube plate is made up of separate trapezoidal sections with gaps therebetween, which gaps are intended for passage of a heat transfer agent in the axial direction into the intertubular space at the inlet and outlet portions of the heat exchanger, inlet and outlet collectors being connected to each section of the upper and lower tube plates, respectively, for the supply of the heat transfer agent into the heat transfer tubes.

1 Claim, 6 Drawing Figures

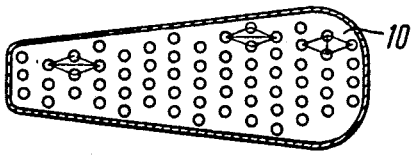
FIG.3
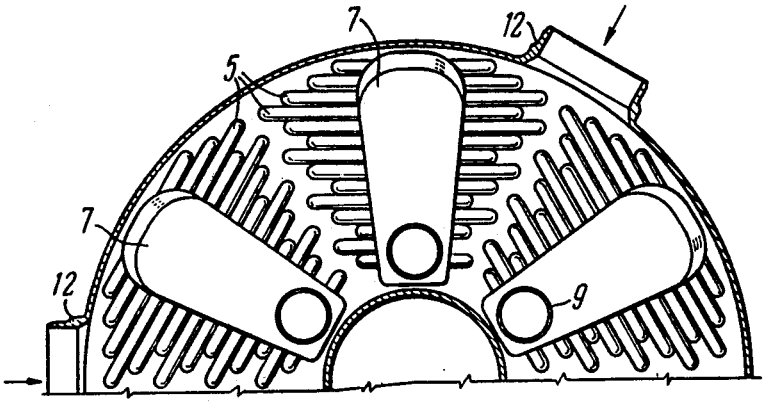
FIG.4
FIG.5
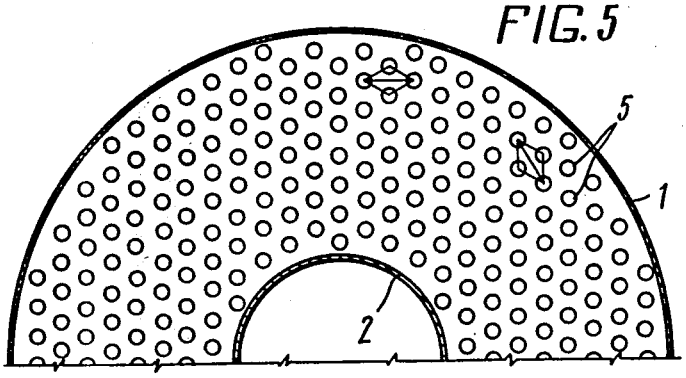

SHELL-AND-TUBE HEAT EXCHANGER

The present invention relates to shell-and-tube heat exchangers and is applicable, for example, in nuclear power plants wherein fluids or gasses are used as a heat-transfer agent. The commonest type of heat exchanger for nuclear power plants that are at present in the design stage or under construction is the shell-and-tube heat exchanger with straight heat transfer tubes. There is also known a shell-and-tube heat exchanger comprising a hollow core with an array of heat transfer tubes around said core, which heat transfer tubes are uniformly spaced over the cross-section of the heat exchanger and are secured at both sides in tube plates. The tube plates may be disc-shaped, as, for example, in the heat exchanger of the US "Enrico Fermi" plant. In this heat exchanger the tube plates are perpendicular to the heat transfer tubes. The heat transfer tubes are uniformly mounted over the surface of the disc.

Tube plates of the heat exchanger disclosed in French Patent Specification No. 1,199,130,Cl. F25L, of 1958, are cone-shaped. Heat transfer tubes are uniformly mounted over the surface of the cone.

Tubular plates of the heat exchanger of USSR Inventor's Certificate No 338,767,Cl. F 28d 7/00, of 1969, are constructed in the form of a polyhedral truncated pyramid. The heat transfer tubes are combined into groups, and the groups are so mounted on each face of the truncated pyramid that channels are defined between adjacent groups for the passage of a heat transfer agent to the central portion of the heat exchanger.

The known heat exchangers have, to a varying degree, one disadvantage in common which resides in the fact that the tube plates, supporting the tubes disposed around the hollow core, are solid, which hinders the passage of the heat transfer agent to the heat transfer tubes arranged in the center, due to a considerable hydraulic resistance which appears as the heat transfer agent flows in the transverse direction with respect to the positioning of the heat transfer tubes at the inlet and outlet portions of the heat exchanger. The result is a non-uniform flow rate of the heat transfer agent over the cross-section of the heat exchanger and, consequently, a non-uniform temperature field of the heat transfer agent at the inlet and outlet portions of the heat exchanger. Thus, the heat exchange surface is used only partially, which accounts for low thermophysical characteristics of the heat exchanger. It should be noted in this connection that an increase in the number of tube rows from the periphery to the central portion of the heat exchanger only contributes to the non-uniformity of the heat transfer agent flow rate.

In the heat exchanger according to USSR Inventor's Certificate No 338,767, Cl. F 28d 7/00, the above problem is partially solved as a result of the fact that groups of heat transfer tubes are so mounted on the tube plate faces that channels are defined between adjacent tube groups for passage of the heat transfer agent to the central portion of the heat exchanger. From these channels the heat transfer agent enters the intertubular space.

The design of tube plates according to USSR Inventor's Certificate No 338,767, Cl. F 28d 7/00, improves, to a certain extent, the flow rate of the heat transfer agent over the cross-section of the heat exchanger due to the fact that the heat transfer agent enters the intertubular space from the channels defined by adjacent groups of heat transfer tubes. Thus, the heat transfer agent has to travel over a shorter distance to reach the most remote tube. Experience has shown, however, that the hydraulic resistance in these channels is so great that it is impossible to ensure a uniform flow rate of the heat transfer agent over the cross-section of the heat exchanger solely through using tube plates of the above-mentioned design.

It is an object of the present invention to reduce the hydraulic resistance at the inlet and outlet portions of a heat exchanger.

It is another object of the present invention to ensure a maximum flow rate uniformity of the heat transfer agent.

It is still another object of the present invention to ensure a uniform temperature field across the tube bundle.

The foregoing objects are attained by providing a heat exchanger comprising a hollow core and tube plates disposed around said hollow core and inclined with respect to tubes secured in said plates, the tube plates being made up of separate trapezoidal sections and arranged so that gaps are defined between adjacent plate sections, which gaps ensure free ingress of a heat transfer agent in the axial direction into the intertubular space at the inlet and outlet portions of the heat exchanger.

Due to the fact that the heat transfer agent enters and leaves the tube bundle in the axial direction, the hydraulic resistance at the inlet and outlet portions of the heat exchanger is reduced to a minimum. A reduced hydraulic resistance at the inlet and outlet portions of the heat exchanger, in turn, ensures maximum uniformity of the heat transfer agent flow rate over the cross-section of the tube bundle, irrespective of the size of the heat exchanger. The uniform flow rate of the heat transfer agent across the tube bundle, in turn, ensures a uniform temperature field of the heat transfer agent. Finally, dividing the tube plates into separate sections simplifies the tube plate manufacture.

Other objects and advantages of the present invention will become more apparent from the following detailed description of a preferred embodiment thereof to be read in conjunction with the attached drawings, wherein:

FIG. 3 shows a tube plate section;

FIG. 4 is a sectional view taken along the line IV—IV of FIG. 1;

FIG. 5 is a sectional view taken along the line V—V of FIG. 1;

Figure 1:
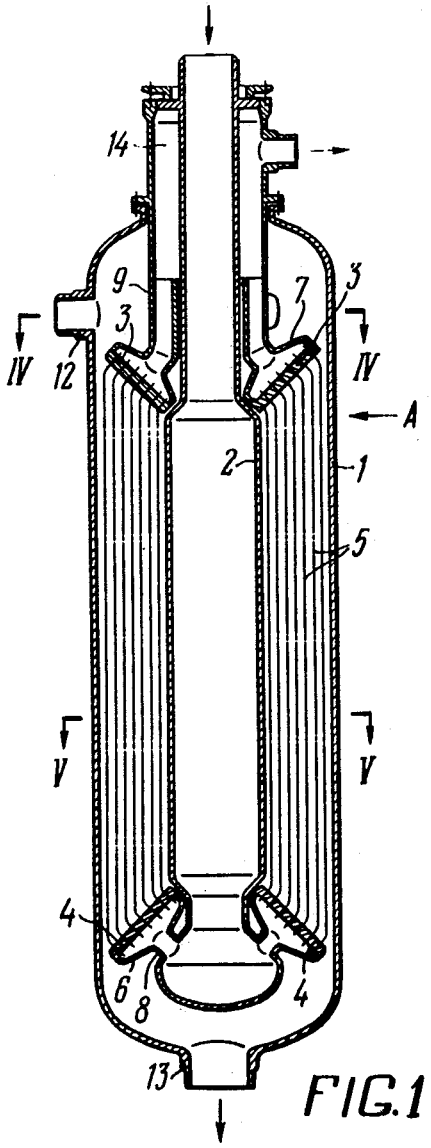
FIG. 1 is an elevation view of a shell-and-tube heat exchanger in accordance with the present invention.
Figure 6:
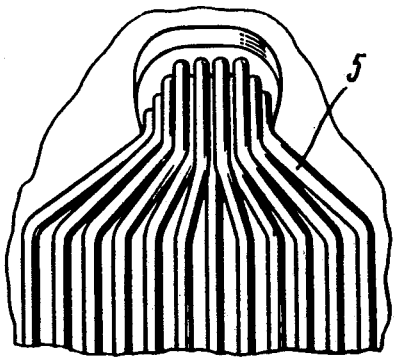
FIG. 6 is a view in the direction of the arrow A of FIG. 1.

Referring now to the accompanying drawings, the shell-and-tube heat exchanger of the present invention comprises a cylindrical shell 1 (FIG. 1), a hollow core 2, an upper tube plate 3, a lower tube plate 4, heat transfer tubes 5, inlet collectors 6, outlet collectors 7, heat transfer agent supply pipes 8, and heat transfer agent discharge pipes 9.

Figure 2:
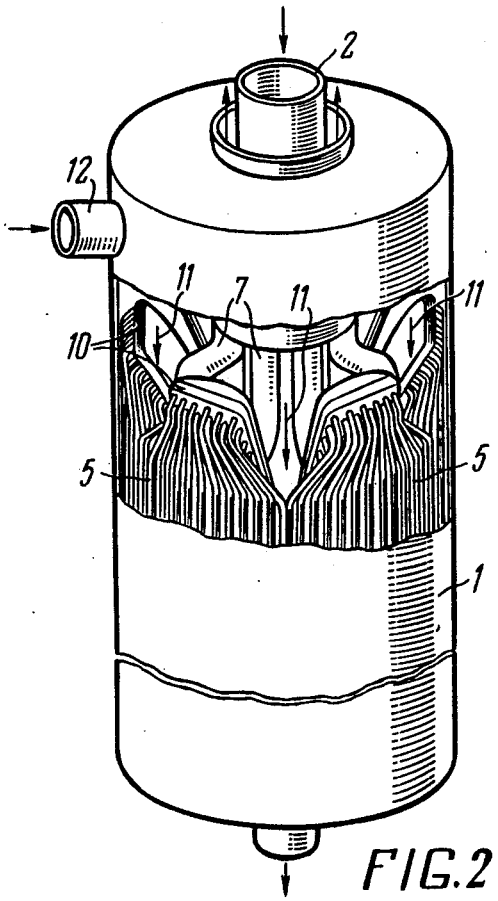
FIG. 2 is a view of the shell-and-tube exchanger with a partially removed shell.

The tube plates 3 and 4 are made up of an array of separate sections 10 (FIG. 3) which are trapezium-shaped, inclined with respect to the heat transfer tubes 5 and arranged so that gaps are defined between adjacent sections 10 of the tube plates 3 and 4. Due to the presence of said gaps, the heat transfer agent enters and leaves the tube bundle in the axial direction, as is shown by an arrow 11 in FIG. 2. Thus, the hydraulic resistance of the inlet and outlet portions of the heat exchanger is reduced to a minimum.

Each section 10 of the tube plates 3 and 4 serves as a bottom of the inlet collector 6 and the outlet collector 7 of the heat transfer agent passing through the tubes 5.

The collectors 6 and 7 may be shaped as shown in FIG. 1. Connected to these collectors are collector pipes 8 and 9 for the supply and discharge of the heat transfer agent, respectively.

The heat transfer tubes 5 (FIG. 5) are uniformly spaced over the cross-section of the heat exchanger. At the inlet and outlet portions of the heat exchanger, the heat transfer tubes 5 are bent so that gaps are defined between the bundles of the tubes 5 secured in adjacent sections 10 of the tube plates 3 and 4, which gaps are intended for the heat transfer agent to enter and leave the tube bundle.

Through a branch pipe 12 (FIG. 1), the heating agent is supplied to the upper portion of the heat exchanger and, after passing through the gaps between the sections 10 of the upper tube plates 3, enters the intertubular space of the heat exchanger.

As the heating agent moves downward, it gives up heat to the heat-consuming agent flowing inside the tubes 5. Upon leaving the tube bundle, the heating agent enters the gaps between the sections 10 of the lower tube plates 4 and leaves the heat exchanger through a branch pipe 13.

The heat-consuming agent is supplied from above to the hollow core 2 which at its lower portion branches into several pipes 8 whose number corresponds to that of the tube bundle sections. Attached to the ends of the pipes 8 are the inlet collectors 6 of the sections 10 of the lower tube plates 4. Through the supply pipes 8 the heat-consuming agent enters the inlet collectors 6 and then, the heat transfer tubes 5. As the heat-consuming agent moves upward through the heat transfer tubes 5, it warms up and at the upper portions of the heat exchanger enters the outlet collectors 7 and therefrom, the discharge pipes 9. The pipes 9 are combined in one annular gap 14 (FIG. 1), through which the heat-consuming agent moves upward, to the outlet of the heat exchanger.

In the heat exchanger of the present invention the tube plates are divided into separate sections, each of said sections being connected to a respective collector for the supply and discharge of the heat-transfer agent, which considerably simplifies the manufacture of the tube plates and of the heat exchanger as a whole. Between the tube plate sections there are gaps, so that the heat transfer agent, which is supplied to the heat exchanger from above, enters the tube bundle with a minimum hydraulic resistance at the inlet portion; this is also the case at the outlet portion of the heat exchanger. The number of tube plate sections and, consequently, of tube bundles attached to each section may be large; as a result, the number of tube rows extending from the periphery to the central portion of each section may be small. This helps to attain a maximum uniformity of the flow rate of the heat transfer agent across the tube bundle of the heat exchanger.

The result is a uniform temperature field over the cross-section of the heat exchanger, which, in turn, substantially improves the thermophysical characteristics of the heat exchanger.

In addition, the above heat exchanger design makes it possible, in the case of a rupture of a tube, to remove and replace only that section to which the ruptured tube belongs, which substantially facilitates maintenance of the heat exchanger.

What is claimed is:

1. A shell-and-tube heat exchanger having upper and lower portions and inlet and outlet portions comprising a shell having a wall; a tubular core axially disposed inside said shell; heat transfer tubes uniformly spaced inside said shell defining an intertubular space, between the shell wall and said core; upper and lower tube plates disposed at the upper and lower portions of the heat exchanger for said heat transfer tubes to be secured therein; each of said tube plates consisting of an array of separate trapezoidal sections, said sections of the tube plates being inclined relative to the heat transfer tubes secured therein and to said tubular core, so that gaps are formed between adjacent sections, which gaps ensure free passage of a heat transfer agent in the axial direction into the intertubular space at the inlet and outlet portions of the heat exchanger; inlet and outlet collectors connected to each section of the upper and lower tube plates, respectively, for the supply of the heat transfer agent into said heat transfer tubes.

* * * * *